US009607443B2

(12) United States Patent
Harvey et al.

(10) Patent No.: US 9,607,443 B2
(45) Date of Patent: Mar. 28, 2017

(54) PORTABLE RACE DEVICE FOR DISPLAYING REAL-TIME RACE INFORMATION

(71) Applicants: Peter Randall Harvey, Piedmont, CA (US); Andrew Harvey, Piedmont, CA (US); Grace Harvey, Piedmont, CA (US)

(72) Inventors: Peter Randall Harvey, Piedmont, CA (US); Andrew Harvey, Piedmont, CA (US); Grace Harvey, Piedmont, CA (US)

( * ) Notice: Subject to any disclaimer, the term of this patent is extended or adjusted under 35 U.S.C. 154(b) by 162 days.

(21) Appl. No.: 14/186,751

(22) Filed: Feb. 21, 2014

(65) Prior Publication Data

US 2014/0244010 A1 Aug. 28, 2014

Related U.S. Application Data

(60) Provisional application No. 61/769,034, filed on Feb. 25, 2013.

(51) Int. Cl.
*A63F 9/14* (2006.01)
*G07C 1/24* (2006.01)

(52) U.S. Cl.
CPC ..... *G07C 1/24* (2013.01)

(58) Field of Classification Search
USPC ..... 700/91; 340/573, 309, 323
See application file for complete search history.

(56) References Cited

U.S. PATENT DOCUMENTS

| | | | | |
|---|---|---|---|---|
| 7,969,314 | B2 * | 6/2011 | Boyd et al. | 340/573.1 |
| 8,207,843 | B2 | 6/2012 | Huston | |
| 8,249,626 | B2 * | 8/2012 | Huston | 455/456.3 |
| 8,432,489 | B2 | 4/2013 | Arseneau et al. | |
| 8,725,176 | B2 * | 5/2014 | Werner et al. | 455/456.3 |
| 2008/0036587 | A1 | 2/2008 | Meinzen | |
| 2009/0258710 | A1 * | 10/2009 | Quatrochi | A63B 24/0062 463/43 |
| 2010/0056238 | A1 | 3/2010 | Terrell, II | |
| 2010/0160014 | A1 | 6/2010 | Galasso et al. | |
| 2010/0250179 | A1 | 9/2010 | Mariano | |
| 2012/0081531 | A1 | 4/2012 | DeAngelis et al. | |
| 2013/0166049 | A1 | 6/2013 | Werner et al. | |
| 2013/0231760 | A1 | 9/2013 | Rosen et al. | |

* cited by examiner

*Primary Examiner* — Paul A D'Agostino
*Assistant Examiner* — Brandon Gray
(74) *Attorney, Agent, or Firm* — Adams Law Office; Sharon Adams

(57) ABSTRACT

The invention comprises systems and devices for calculating and displaying real-time race information to a racer during a race. A portable race device may be worn by a racer. During the race, while within range of a race gate transmission, the race device receives gate crossing times for other race participants, and may calculate and display the current positions and times for a selected race group, and the pace needed for the racer to win, and also may display the projected finish positions and times for a selected race group, and the pace needed for the racer to win.

20 Claims, 6 Drawing Sheets

| RFID | Group |
|---|---|
| 1000 | 1 |
| 1010 | 1 |
| 1123 | 1 |
| 4005 | 2 |
| 4010 | 2 |

| RFID | Group |
|---|---|
| 1000 | 1 |
| 1010 | 1 |
| 1123 | 1 |
| 4005 | 2 |
| 4010 | 2 |

PORTABLE RACE DEVICE FOR DISPLAYING REAL-TIME RACE INFORMATION

CROSS REFERENCE TO RELATED APPLICATION

This application claims the benefit of U.S. Provisional Application No. 61/769,034, filed Feb. 25, 2013, which is herein incorporated by reference in its entirety.

STATEMENT REGARDING FEDERALLY SPONSORED RESEARCH

Not applicable.

NAMES OF THE PARTIES TO A JOINT RESEARCH AGREEMENT

Not applicable.

BACKGROUND OF THE INVENTION

Field of the Invention

The invention relates to systems, devices and methods for providing real-time participant-to-participant race-comparative information, and for providing a winning strategy.

In large athletic events, it is often the case that competitive athletes do not know who they are racing, how far ahead the leaders are or how fast they are going. Participants are often grouped by age and sex, and the groups are often started at different times in order to lessen the crowding on the race course. In multiple-segment races, such as triathlons, participants typically change clothes between swimming, biking and running Amidst this sea of all participants, it is nearly impossible for participants to know how they are doing in their group, and whether to speed up. Currently, unable to determine race position within the race group, participants blindly finish and hope for the best. If participants had real-time information of the race group leaders, and relative positions, participants could alter their pace enough to make a difference in their finishing positions, perhaps enough to win or place.

Description of the Related Art

State of the art products focus upon the participant's heart rate, cadence and pace. Most store personal data for later download to computer and display. Some current devices allow a participant to "virtually" race someone in the past. While these devices are great for training, and are used to regulate pace in a race, they universally fail to provide essential data for a participant to know how to win today's race.

State of the art race operators provide verification that each participant has traversed the entire race course by laying out "gates" through which all registered participants must travel. Race operators provide each registered participant with an identification tag, so that each gate can record the participant as the participant passes the gate. Typically, all registered participants are required to wear an RFID (radio-frequency identification) tag, or some similar device for wireless, short-distance transmission of a signal from the race participant to the race gate mat. A gate computer collects the time each participant passes through each gate. At the conclusion of the race, the race operator prints out the "Finish Gate" results and posts the results to a swarm of participants anxious to find out their position in the race; that is to say, who came in first, second, third, etc. Until these results are posted, participants generally do not know their race position. It may happen that a participant learns after the race that he or she was only seconds off the podium.

After the event, race operators collect the data from all gates and within a few days, provide details on websites about gate times for each participant. Some races may be triathlons, involving swimming, bicycling and running race segments, while other races may be a single event, like running, one or more times around a race course, passing a gate at each race segment. These are generally termed "split times". From the website display of gates times, a given participant can determine his or her split times for each race segment, e.g. the participant took 00:32:05 on the swim, 00:06:02 in transition to bike, 03:05:30 on the bike, 00:01:30 in transition to run, and 02:01:30 on the run. While these details may be helpful for future races, they are useless to the participant wanting to win today's race, in real-time.

Some race operators are capable of transmitting gate results to websites during a race, and some even provide projected finish times for each participant. However, these provide no information to the participant during the race.

BRIEF SUMMARY OF THE INVENTION

Embodiments of invention are directed to systems and devices for having competition-relative functionality to determine real-time race position and other information. In some embodiments, the wearable race device is worn by a participant on the wrist, similar to a wristwatch. The race device comprises an antenna or other receiver capable of receiving information from each race gate, and a processor capable of computing and displaying competition data on a screen.

Each race course has a plurality of race gates, comprising a start gate, a finish gate and at least one mid-course gate. Each race gate is comprised of a race gate mat, an associated computer with software and a transmitter capable of transmitting to the antenna or other receiver connected with the race device.

A race gate transmitter broadcasts race gate information and the gate crossing times of all participants. In some embodiments, a transmitter may be attached to the standard gate computer used by the race operator, or could be attached to a stand-alone computer. This would include a small RF transmitter and a software module in the computer to collect and format a broadcast to all race devices within range.

When a racer wearing the race device comes within range of each race gate, the wearable race device receives data transmitted from the race gate. The device may display identities of the race-group leaders, the leader times through that gate, the racer's current position and time back from the leader. The racer may view this information in real-time shortly after transiting each race gate.

Upon receiving the race gate data, the wearable race device may calculate the pace of each race group participant, and forecast the positions of race group leaders at the finish line, the racer's projected finish position and time back. Using the projected winning time of the race group leader and the racer's distance to the finish line, the race device may also compute and display the pace needed by the racer in order to win the race, or the race segment.

The systems and devices described herein will provide current race position (first, second, etc.); the time difference between a racer and the competition; information about the competition; and information on how to win today's race, in real-time, during the race.

The systems and devices described herein will make races more exciting to the participants as well as spectators. All race participants wearing the devices would be able to continually adjust their race strategy based upon the real-time knowledge of their competition. They could adjust their effort to the limit of their abilities, and races would become extremely competitive as a result. Spectators could receive real-time information about a racer. Race operators would be delivering a more exciting race venue. Communities would see an increase in spectators to these events since they would be able to follow the "gate-by-gate" drama in the race.

DESCRIPTION OF THE SEVERAL VIEWS

DETAILED DESCRIPTION

As used herein, "race course" means a race course as having a start gate, a finish gate and at least one mid-course gate, wherein the start gate and finish gate may be the same gate.

As used herein, "race group" means a subset of all the participants on the course and who are competing against each other; an exemplar race group could be those who are male between 30 and 34 years of age.

As used herein "race position" is 1st, 2nd, 3rd etc., implying fastest, next to fastest, and so forth within the race group.

As used herein "racer" is a participant connected with a race device.

As used herein "gate information" may include a unique gate identifier, gate type (such as start, transition, finish, etc.), and gate time.

As used herein "course information" may detail the order of the gates, their type, and their distance within the course.

As used herein "participant list" may be a comprehensive list of all registered participants in all race groups, where each participant is identified with a specific group.

As used herein "participant crossing times" may be a listing of all participants having crossed a specific gate, including the number of times each participant has crossed the gate and the time of the last transit.

Figure 2:
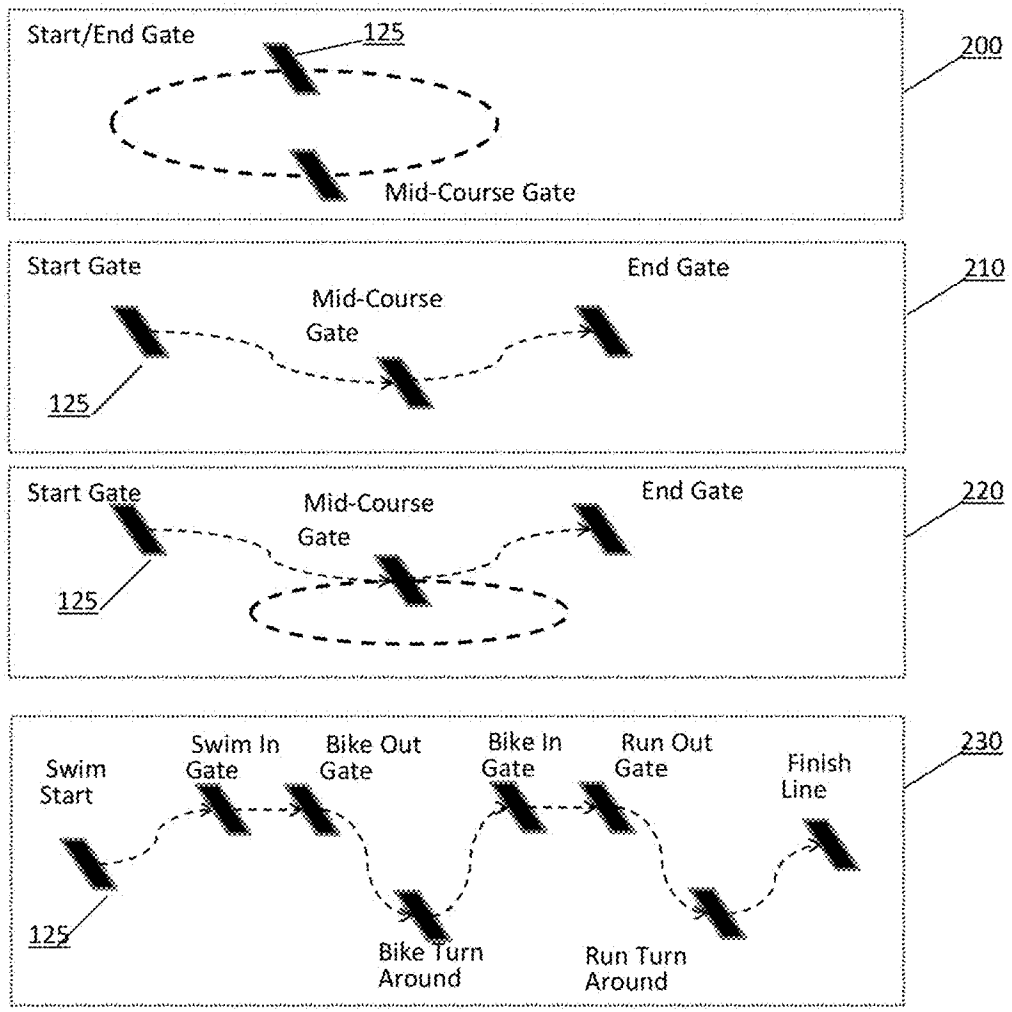
FIG. 2 shows exemplary race course configurations.

Participant and Race Group Identification. In a race, each registered participant has a specific identification number, and the identification number is linked to the race group for the participant. As a non-limiting example, all males between the age of 40 and 49 may be in one race group, all females between the ages of 40 and 49 may be in a second race group, and other ages/gender combinations in other race groups. The racer information may be encoded on an RFID or similar device 110, and each participant is required to wear this identification device during the race. The start and finish gate may be the same gate, as shown in FIG. 2.

Race Gate Definition. Each race gate 125 is comprised of race gate mat 120, race gate computer 130 with software 140 connected with transmitter 150. Each race course with race gates 125 will generally be comprised of a start race gate, a finish race gate, and at least one mid-race race gate, as shown in FIG. 2.

Race Course Configuration. Before a race begins, race gates 125 are set up with the desired race course configuration. As a non-limiting example, one race course configuration may comprise a plurality of race gates 125 to record in and out times for transitioning between swimming, bicycling and running segments of a triathlon, as in race configuration 230. Another non-limiting, exemplar configurations is shown in race configuration 200, having a single event race loop (whether running, bicycling, swimming or other); another in race configuration 220, having a mid-course loop; and another in race configuration 210, having a straight course. Race gates 125 may be used in any variation of race course configurations as needed, and to measure any type of race segment, event or transition within a race.

Race Gate Records and Transmits Crossing Times. Race gate 125 is comprised of race gate mat 120, computer 130, software 140 and transmitter 150. During the race, racer information device 110 transmits to a race gate mat 120 as each registered participant comes crosses the mat. Race gate mat 120 is in communication with computer 130 and software 140 Participant crossing times are transmitted 155 from race gate 125 to race device 100. This can be transmitted from an official race computer associated with each gate, or from a non-official computer and transmitter associated with a gate, or by cellular communication, or by any other means of transmitting and receiving data information or signals.

Race Gate Time Precision. While race gates typically provide time to a fraction of a second, this level of precision may be not required by racers. Therefore, in some embodiments, to limit data volume, only integer seconds may be transmitted. Other embodiments may provide the precise level of time as desired, including to fractions of a second. Time will typically be measured as either (a) absolute or (b) elapsed race time.

Race Gate Transmitter. Transmitters 150 are capable of transmitting information, signals or data over range 160 from race gate 125 to at least one race device 100. Transmitter 150 may be integral to, or connected directly with computer 130, or transmitter 150 may be a separate device from computer 130. The transmitted information may include gate information and participant crossing times. The start gate may also transmit information comprising the full participant list, race group and participant identification.

Figure 4:
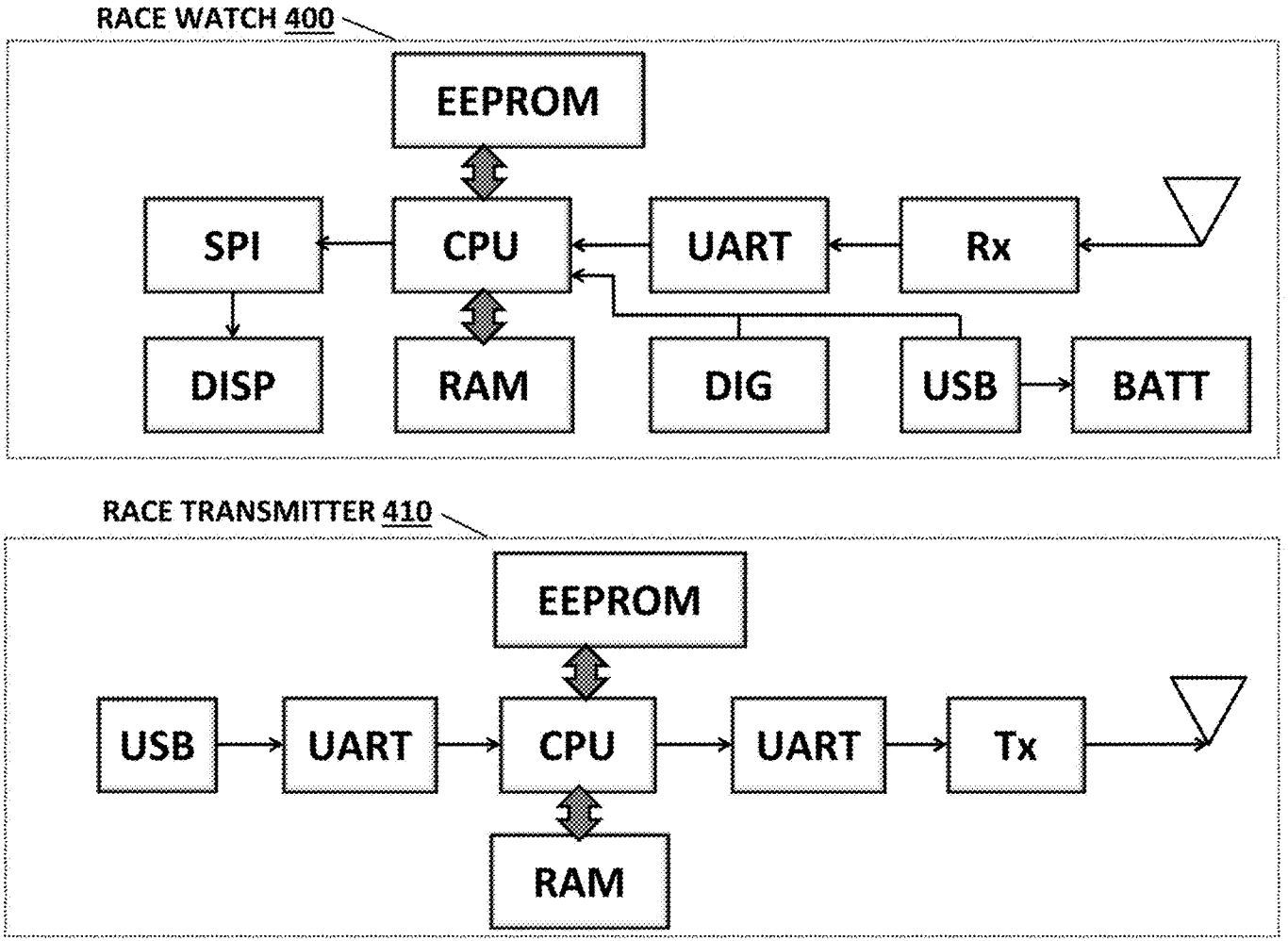
FIG. 4 is a schematic diagram of an embodiment of the race device and race transmitter.

Gate Transmitter Electrical Description. In some embodiments, race transmitter 410 electronic components may include those in FIG. 4, as follows:

(a) a universal serial bus (USB) interface and a serial-to-parallel converter such as a Universal Asynchronous Receiver/Transmitter (UART) for receiving participant crossing data from the gate and possibly reprogramming the EEPROM;

(b) an electrically erasable read only memory (EEPROM) for storing the race transmitter 410 programming;

(c) random-access memory (RAM) for storing the participant crossing times and preparing broadcast messages;

(d) a central processing unit (CPU) for running the program, recording participant crossing events, and formatting broadcast messages; and (e) a serial-to-parallel converter such as a Universal Asynchronous Receiver/Transmitter (UART), transmitter circuitry, and a radio frequency antenna, to broadcast the messages.

Gate Transmitter Range. Each transmitter 150 transmits 155 in an effective range 160, which is the distance and time during which a racer wearing the device 100 may receive information from the race gate transmission. The transmission is continuous, or essentially continuous, during the race event. As a non-limiting example, a race gate transmitter at 400-2400 MHz has a range between 300 and 3000 meters depending upon data rate. Using 300 meters as a reference, runners at a 6 minute/mile pace would be in range 1 minute before and 1 minute after the gate, so the period in range of the gate would be about 2 minutes. Cyclists at 30 MPH would be in range for a total of 44 seconds.

Gate Transmitter Range Example. As a non-limiting example, transmitted gate data volume may include gate information and participant crossing times. Gate information may be comprised of 8-bit Gate Identification, 8-bit Type, and 32-bit Gate Time. Participant crossing times may be comprised of 48 bits per participant, 20 bits for Participant Number, 4 bits for Visit Number, and 24 bits for Time Visited. Using a modest data transfer rate of 110 kbps, a gate could transmit data for up to 37,000 cyclists in the 22 seconds between the time a cyclist transits the gate and exceeds the 300 meter range. Similarly, a gate could transmit data for over 111,000 runners between the time a runner transits the gate and exceeds the 300 meter range.

Gate Transmitter Messaging. Transmitted gate data could potentially be compressed, split into multiple short messages (e.g. by age-group or other race group), or sent on multiple frequencies (e.g. one for men, one for women or other group), to increase bandwidth without changing the basic idea. Any means of compressing and/or dividing data may be used to put data in packets or signals that may be easily and rapidly transmitted.

Gate Transmitter Course Tailoring. In some embodiments, the gate transmitters 150 may have a different frequency or range for different portions of the course. As a non-limiting modification of the example above, a transmitter may transmit over a larger distance at the bicycle split, so that cyclists traveling at 30 mph could also be within the effective range 160 for approximately 2 minutes.

Gate Transmitter Signal Types. In other embodiments, there may different type of transmission signals (cellular, GPS or other) each with a unique effective range. It is apparent that the effective range may be varied as needed, to allow racers with wearable race device 100 enough time to receive the data, packets or signals transmitted by the gate.

Figure 5:
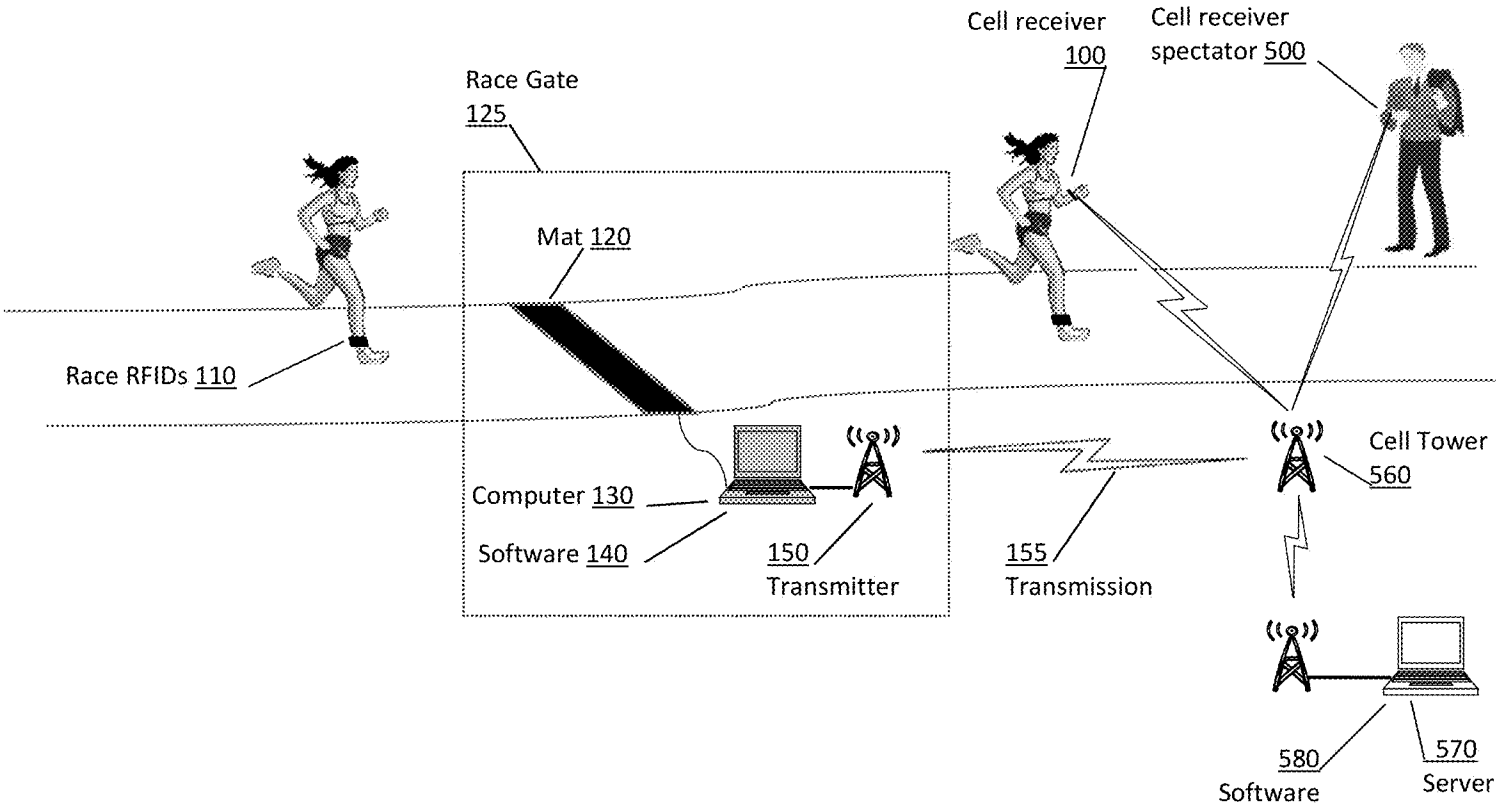
FIG. 5 is an exemplary race gate set up, showing other embodiments for transmitting over an effective range to a racer wearing an embodiment of the invention.
Figure 6:
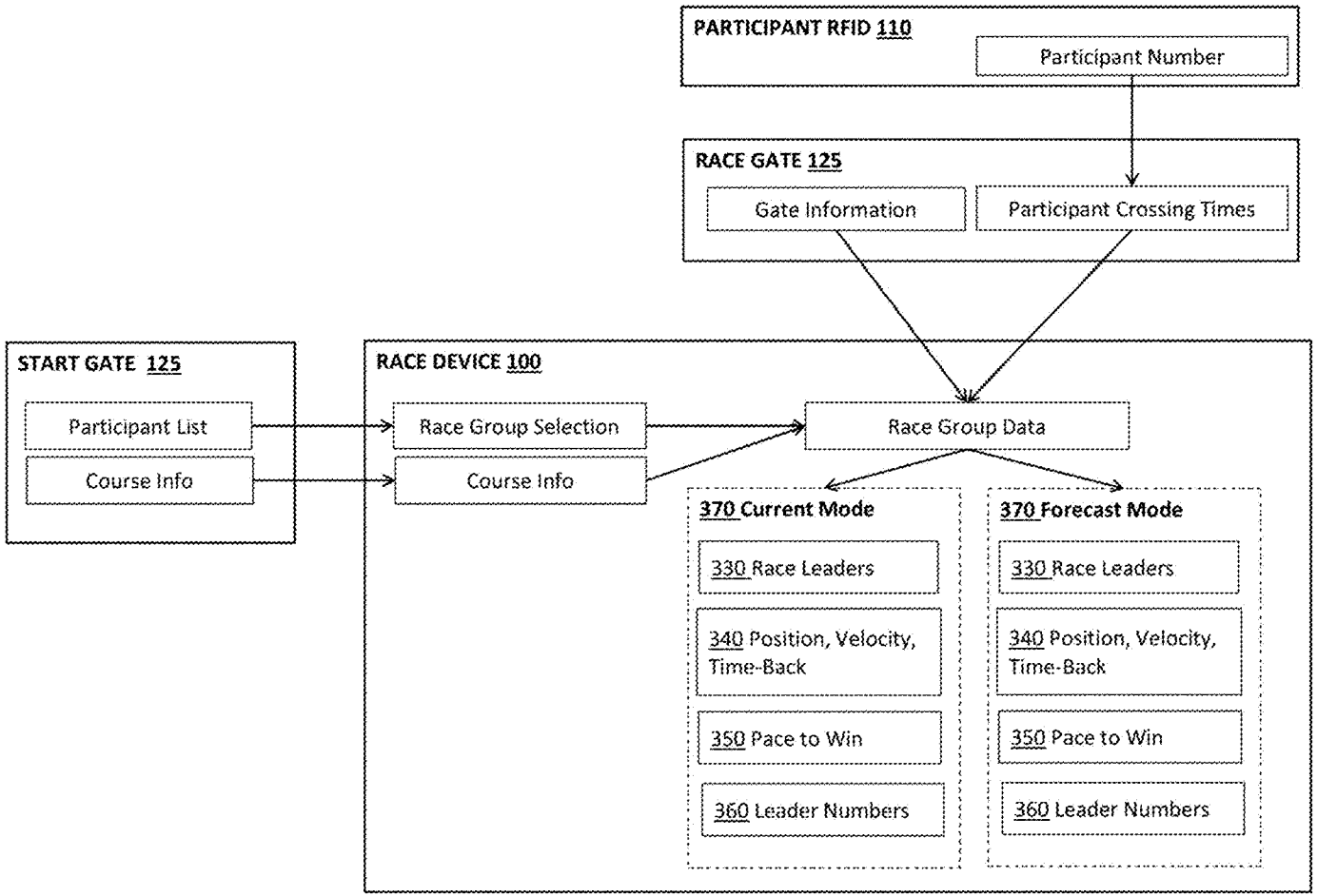
FIG. 6 shows a relational diagram of an embodiment of the invention.

Alternate embodiments May Use Cellular Technology. Alternate embodiments of the invention could make use of cellular technology, as shown in FIG. 5, to connect the race gates 125 via cellular transmission 150 and cell tower 560 to a central server 570. Software 580 in server 570 would provide race device 100 calculations and information described above, transmit to cell receiver in device 100, and provide either web-based displays or text messages to the racer. In some embodiments, the cellular transmissions may be received by at least one spectator with a cellular receiver 500.

Race Gate Data. Supporting easy deployment in the field and a variety of race course configurations, a gate may be visited several times during an event. Thus, the race device 100 may receive transmissions each time the device is within range 160 of a particular gate.

Race Gate Data Example. As a non-limiting example, course 220 shows a course with a start gate, a mid-course gate that is visited 3 times, and a finish gate. In this example, assume a 30 km course, with the mid-course gate placed 5 km from the start gate, and 5 km from a separate finish gate. The mid-course gate is visited three times in a 10 km loop. The gates could be configured with matrices as shown in Table 1.

TABLE 1

Example of Distance-to-Finish Matrix on a 30,000 km course, with a Start Gate, 3 visits to Mid-Gate and a Finish Gate.

| | Distance to Finish Line |
|---|---|
| START GATE Visit Number | |
| 1 | 30000 |
| MID-GATE Visit Number | |
| 1 | 25000 |
| 2 | 15000 |
| 3 | 5000 |
| FINISH GATE Visit Number | |
| 1 | 0 |

Race Gate Participant Crossing Times Example. An exemplar display of gate participant crossing times may include participant identification number, gate visit number, and time visited. An exemplar matrix is shown in Tables 2a, 2b, 2c, 2d and 2e for race course configuration 220. It is required that the participant identification tag (e.g. number) is unique, but order is not important. Times can be either absolute time or relative to the beginning of the race (elapsed time).

TABLE 2a

Start Gate example showing 2 waves of participants starting at 11:00 and 11:05

| Participant Number | START GATE Visit Number | Time Visited |
|---|---|---|
| 1000 | 1 | 11:00:01 |
| 1010 | 1 | 11:00:00 |
| 1123 | 1 | 11:00:02 |
| 4005 | 1 | 11:05:01 |
| 4010 | 1 | 11:05:00 |

TABLE 2b

Mid-Course Gate Visit #1

| Participant Number | MID-GATE Visit Number | Time Visited |
|---|---|---|
| 1000 | 1 | 11:21:46 |
| 1010 | 1 | 11:22:16 |
| 1123 | 1 | 11:23:20 |
| 4005 | 1 | 11:25:44 |
| 4010 | 1 | 11:26:14 |

TABLE 2c

| Mid-Course Gate Visit #2 | | |
|---|---|---|
| Participant Number | MID-GATE Visit Number | Time Visited |
| 1000 | 2 | 12:06:18 |
| 1010 | 2 | 12:07:50 |
| 1123 | 2 | 12:08:54 |
| 4005 | 2 | 12:08:11 |
| 4010 | 2 | 12:07:39 |

TABLE 2d

| Mid-Course Gate Visit #3 | | |
|---|---|---|
| Participant Number | MID-GATE Visit Number | Time Visited |
| 1000 | 3 | 12:51:52 |
| 1010 | 3 | 12:53:24 |
| 1123 | 3 | 12:53:57 |
| 4005 | 3 | 12:51:41 |
| 4010 | 3 | 12:49:05 |

TABLE 2e

| Finish Gate | | |
|---|---|---|
| Participant Number | FINISH GATE Visit Number | Time Visited |
| 1000 | 1 | 13:15:10 |
| 1010 | 1 | 13:16:11 |
| 1123 | 1 | 13:16:13 |
| 4005 | 1 | 13:13:57 |
| 4010 | 1 | 13:10:19 |

Figure 1:
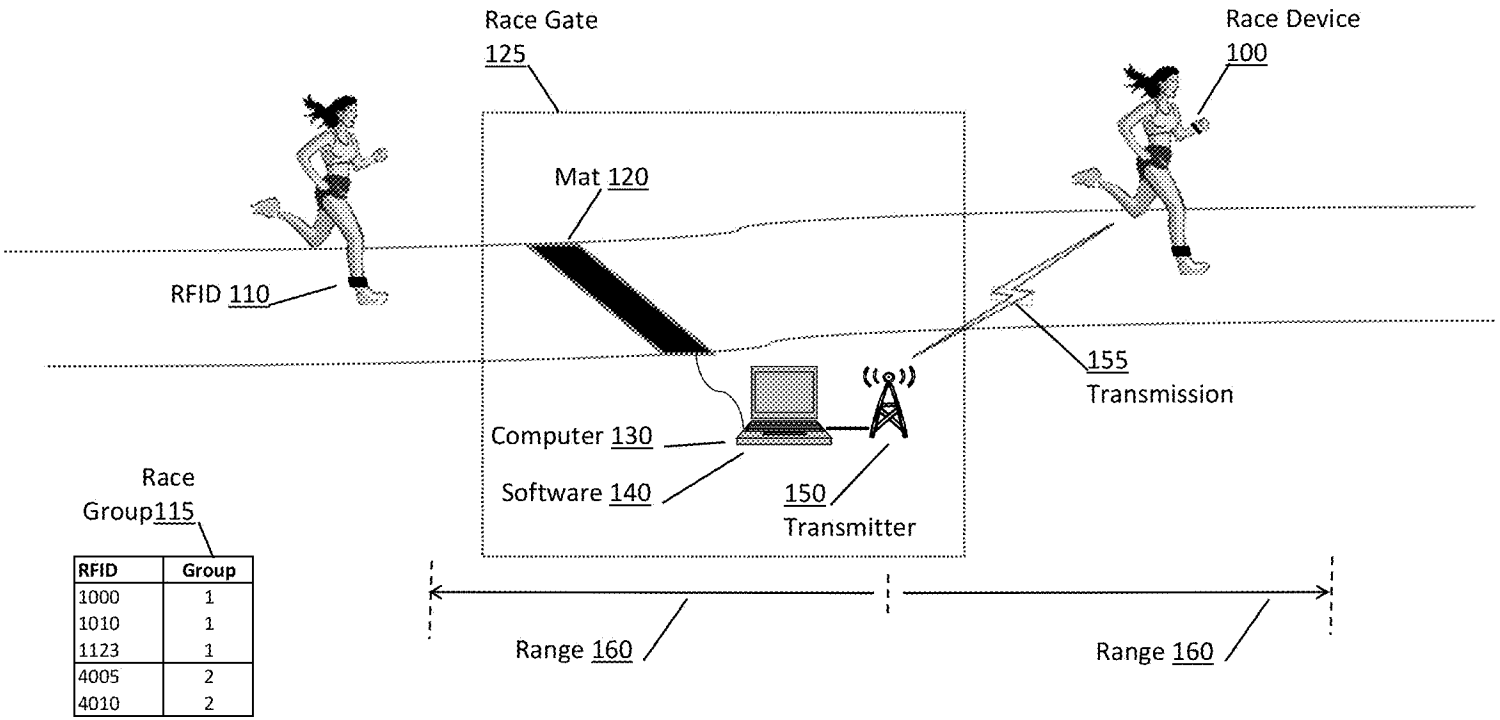
FIG. 1 is an exemplary race gate set up, showing an embodiment of the invention comprising a race gate mat, computer, and associated software and transmitter, transmitting over an effective range to a racer wearing an embodiment of the invention.
Figure 3:
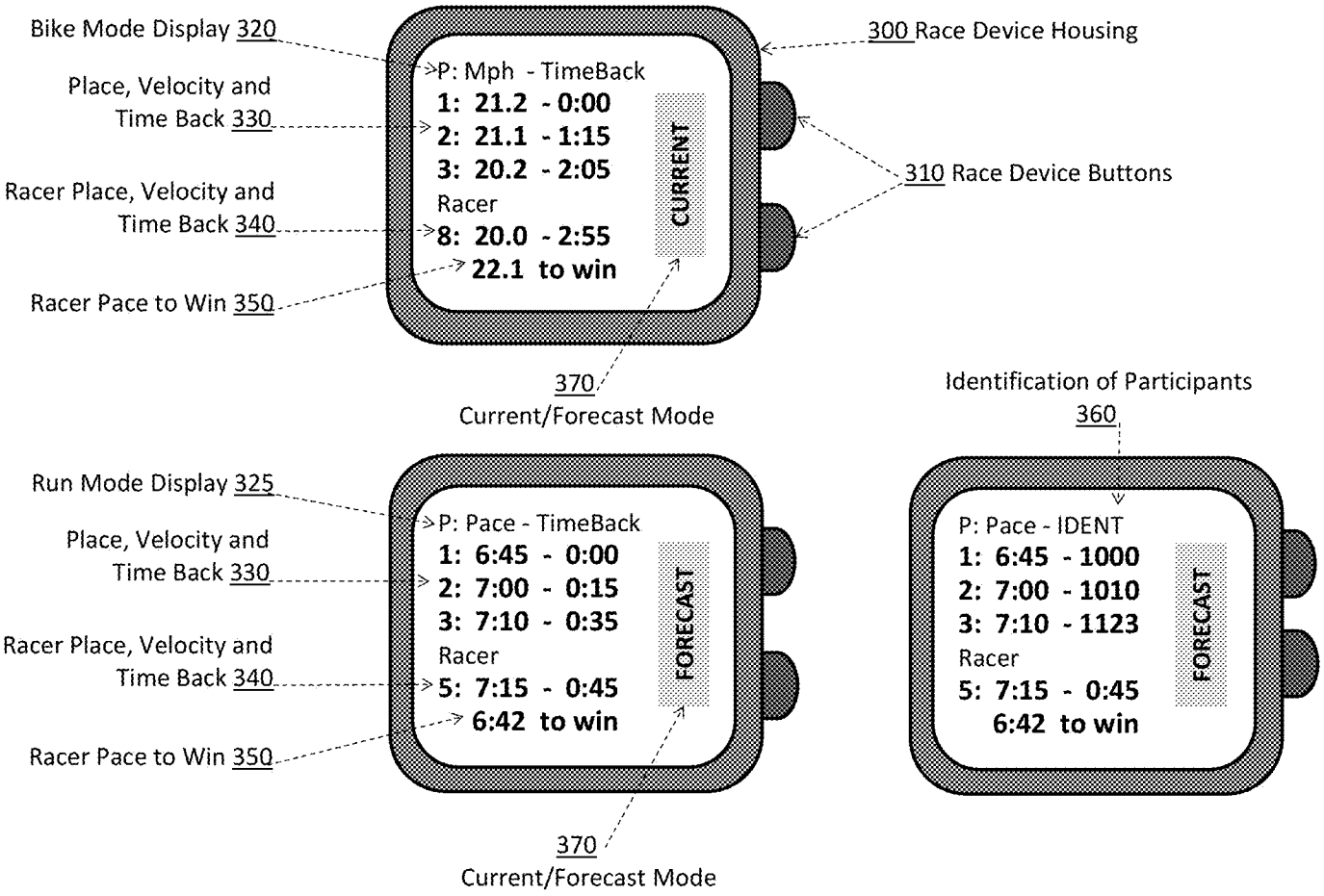
FIG. 3 is an embodiment of the race device displaying exemplary race information on an embodiment of the race device screen.

Race Device Mechanical Description. In some embodiments race device 100 is a wearable device with housing 300 and buttons 310 that may be used to program the device to perform various functions. In preferred embodiments, race device 100 in similar to a wristwatch and has a similar screen. Race device 100 may be a separate device as shown in FIG. 1. In other embodiments, race device 100 may be connected with racer identification device 110 provided to each registered racer, as a single wearable device. Race device 100 may display the computed values as selected by racer on a screen visible to the racer, as shown in FIG. 3. In other embodiments race device may be worn on another part of the body.

Race Device Electrical Description. In some embodiments, race device 100 electronic components may include those in race watch 400, FIG. 4, including (f) a radio frequency antenna, receiver circuitry, a serial-to-parallel converter such as a Universal Asynchronous Receiver/Transmitter (UART) to receive gate transmissions;

(g) an electrically erasable read only memory (EEPROM) for storing and updating the race device 100 programming and optionally the race course information;

(h) random-access memory (RAM) for storing the participant list, participant crossing times, and all other transient calculations;

(i) a central processing unit (CPU) for running the program, processing the gate transmissions, and performing calculations of pace and finish times;

(j) a serial peripheral interface (SPI) from the CPU to the display (DISP) in order to show the information in FIG. 3;

(k) a universal serial bus (USB) interface for charging the battery (BATT) and optionally reprogramming the EEPROM; and (l) a Battery capable of powering the race device 100 for the duration of the race.

Race Device Programming. At least one racer with race device 100 programs the device with a selected race group 115 prior to the start of the race. In one embodiment, the selected race group 115 is the race group for which the racer has registered. In some embodiments, the racer may program a specific person or group of people, such as friends, as the race group 115.

Race Device Receipt of Course Information. Prior to the start of the race, the race device 100 downloads or receives transmission of the participant list, participant number and race group, and course information from a reliable source of information, such as the race operator, a kiosk, the start gate, or from any other source of race information.

Race Device Receipt of Gate Transmission. Within range 160 of each gate 125, race device 100 may do the following: receive information being transmitted from race gate 125, which may comprise both gate information and participant crossing times for that gate. Race device 100 may save gate information as follows:

(a) the gate type visited (as non-limiting examples, bicycle, swim or run, or in- or out-transition gate), and (b) the gate time.

Race device 100 may selectively filter the participant crossing times for participants in the selected race group 115. For each selected participant, it may save data as follows:

(a) the participant number;

(b) the number of visits to the gate, and (c) the gate crossing time.

Race Device Adjusts for Gate Time Offsets. It is possible that the timer or clock at a race gate may not be synchronized with other race gate times, or with real-time, or with the race device 100 time. The race device 100 may compute the offset between the race device 100 time and each gate 125 time, and then apply that offset each participant time received from that gate. Thus, all times are relative to the time in race device 100.

Race Device Computes Pace (Velocity). Unless this is the first gate of a segment (such as biking or running), race device 100 computes the distance travelled between the last two gates. For each participant, using the participant crossing times, race device 100 computes the pace (velocity) by dividing the distance between the last two gates by the difference between the corresponding gate transit times (velocity=distance/time).

Race Device Computes Current Race Positions. Race device 100 computes the race position of the racer within the selected race group 115 by (a) ordering the list of participant times through the last gate to determine the current positions; and (b) finding where the racer's number falls in the ordered list.

Race Device Computes Current Time-Back. Race device 100 may order the list of participants through the last gate to calculate the time-back for member of the list by subtracting the first place participant's time from each of the other participants' times.

Race Device Computes Finish Times. Race device 100 may forecast or predict finish times as follows. For each participant in the race group, race device may use the participant's last known distance to the finish line and divide by their last known pace, and adding that result to the participant's last known crossing time.

Race Device Computes Projected Finish Positions. Race device 100 may predict finishing positions by (a) ordering the list of race group participants by their predicted finishing times; and (b) finding where the racer's number falls in the ordered list. The predicted first place time is on first on the list.

Race Device Computes Pace to Win. Race device 100 may compute the velocity needed for the racer to win by (a) determining the time remaining by subtracting the predicted first place participant's time from the current time;

(b) dividing the racer's distance-to-finish by the time remaining less a programmable amount of time which is the winning margin.

Race Device Displays Current Data. In a preferred embodiment the race device 100 displays the positions, velocity and time-back of the race group leaders 330, and the racer's current position, velocity and time back 340, and a calculated pace to win 350. When in a cycling segment, the units of velocity may be displayed in Mph or Km/h 320. When in a running segment, the units of velocity may be displayed in min/mile or min/km 325. It is apparent that the velocity may be displayed using any metrics necessary to determine race position. In this mode, the display may indicate these data are Current.

Race Device Displays Projected Data. In a preferred embodiment the race device 100 displays the finish-line projected positions, or the segment-finish projected positions, and time-back of the race group leaders 330. The device may display the racer's finish-line projected position, or projected finish position for the segment, and time back 340, assuming the current velocities. Race device 100 may also show a calculated pace to win 350. When in a cycling segment, the units of velocity may be displayed in Mph or Km/h 320. When in a running segment, the units of velocity may be displayed in min/mile or min/km 325. In this mode, the display may indicate these data are forecast.

Race Device Displays Participant's Identities. In a preferred embodiment the race device 100 displays the participant numbers of the leaders 360. By switching the Current/Forecast mode 370, the racer may identify both the current and future leaders of the race group, and use that knowledge on the race course to his/her advantage.

Alternate Embodiments Using GPS Technology. In some embodiments, race device 100 may also use global positioning system (GPS) technology. In these embodiments, the race device 100 may transmit and receive GPS data, and the velocity of each racer with wearable device 100 may be updated more often than when using gate data alone. In these embodiments, the GPS data is used in the calculations described above, and may be used to assist the runner in maintaining the calculated winning pace.

In preferred embodiments, a race operator may use the invention to provide racers with position, pace, time back and pace needed to win. In these embodiments the race operator may provide each racer (or a selected group of racers) with race device 100. Race device 100 may be a separate device, or may be connected with a racer identification device 110. The race operator has race gates 125 set as desired along the race course. Race device 100 receives the race course information (e.g. distance between gates, type of split, type of event, etc). Race device 100 receives participant identification information linking each other participant in the race to a particular race group. During the race, each race gate will receive participant crossing information as the participants pass over the race gate mat 120. When a racer wearing device 100 comes within range 160 of race gate 125, race device 100 will receive gate and participant crossing information transmitted from race gate transmitter 150. And, the race device 100 may calculate the racer's current velocity, time back and position. The race device 100 may also calculate the pace needed for the racer to win the race.

Embodiments of the invention may comprise the following steps: the race gates 125 are set up in a race course configuration;

the race gates are programed to transmit 155 gate information to race device 100 when the race device is within the effective transmission range 160 of each gate;

in a preferred embodiment, the start gate (or kiosk) may transmit race information comprising race course configuration, participant identification information, race group information;

all race gates may transmit race information comprising number of times each gate will be visited by race participants, distance from each gate (taking into account the number of times visited) to finish line, participant identification information and associated crossing times;

registered race participants receive participant identification tags 110 and at least one racer receives race device 100;

at least one racer with race device 100 programs the device with a selected race group;

during the race, in real-time, as the racer with the race device comes within range 160, race device 100 calculates and displays the current and projected leaders of the race group leader, the racer's position, pace, time back and pace to win.

For the majority of participants wearing race device 100, the list of participants ahead will provide motivation and useful data to catch up. This will likely make more close finishes. It may also make events with racer's that wear race devices 100 more exciting to both the participants and spectators than they currently are.

The race device 100 may be used strategically by each racer with the device 100. For example, a racer with racer device 100 may understand that he or she is in first place through a gate and, while in range of the gate, will receive messages containing the race numbers for approaching competitors. For each racer behind the current race leader, the race device 100 will compute the racer's velocity and calculate the pace needed for that racer to beat the current leader to the finish line.

For each racer with the device in a race, when the racer comes within the effective range of the finish gate, the finish gate will transit race information, and will alert each approaching racer as to what positions are remaining Each racer approaching the finish line may know if he/she is battling for first place or tenth place.

The invention may be embodied in other specific forms without departing from the spirit or essential characteristics thereof. The embodiments disclosed in this specification are to be considered in all respects as illustrative and not restrictive, and all changes that come within the meaning and range of equivalency of the claims are intended to be embraced therein.

A recitation of "a" "an" or "the" is intended to mean "one or more" unless specifically indicated to the contrary.

What is claimed is:

1. A system for providing real-time race information to at least one racer in a race comprising:

a race comprising a race course, race gates, one racer with a race device, and a plurality of race participants each with a participant identification device, wherein the racer with the race device and the race participants are competing concurrently in the same race, on the same race course, crossing the same race gates;

the race device comprising a receiver, display, and processor, wherein the racer programs the race device with a race group, and wears the device during the race, and wherein the race group comprises a plurality of race participants;

the race gate comprising a race gate mat, computer, software, and transmitter, wherein each gate transmits gate information over an effective range;

the race course configuration comprising one start gate, at least one mid-course gate, and finish gate, the location of each race gate, the number of times each race gate will be visited, and the distance from the gate to the race finish, and wherein each race gate is programmed with the appropriate race course configuration for the gate;

the participant identification device worn by registered race participants, and encoded to transmit participant information to each race gate as the participant crosses each race gate;

recording, by the race gate computer, a unique participant time linked to each participant when each participant with a participant identification device crosses each race gate;

transmitting, by each race gate transmitter, gate information wherein the gate information transmitted comprises participant identification information and linked unique participant time, race course configuration, and wherein said information is transmitted over an effective range;

receiving, by the race device when the racer with the race device is within the effective range of each race gate, gate information transmitted from each gate transmitter;

processing, by the race device processor, the received information, and displaying real-time race information to the racer with the race device while the racer is on the race course and in time to affect the outcome of the race.

2. The system of claim 1 wherein a plurality of racers each wears a race device.

3. The system of claim 1 wherein the real-time race information is comprised of the current race group leader, the projected race group leader, the racer's position, time, time back, velocity, and pace needed to win.

4. The system of claim 1 wherein the race gate transmission is continuous.

5. The system of claim 1 wherein the race gate transmission is in packets.

6. The system of claim 1 wherein the race gate may signify a race-segment finish.

7. The system of claim 1 wherein the information transmitted by each race gate transmitter comprises race course configuration information and participant time information.

8. The system of claim 1 wherein the participant identification device is connected with the race device.

9. The system of claim 1 wherein the participant identification device is separate from the race device.

10. The system of claim 1 wherein a single race gate may be programed to function as the start gate, the mid-course gate and the finish gate.

11. The system of claim 1 wherein a single race gate may be programmed to function as a plurality of gates.

12. The system of claim 11 wherein a single race gate may be programed to function as the start and finish gate.

13. The system of claim 1 wherein the race group is comprised of the race event group classification.

14. The system of claim 1 wherein the race group is comprised of specifically selected race participants.

15. The system of claim 1 wherein the race gate transmitter is separate from the race gate computer.

16. The system of claim 1 wherein the participant information transmitted by the participant identification device comprises the participant identification number and participant race group.

17. A system for providing real-time information to a plurality of racers in a race comprising:

a race comprising a race course, race gates, one racer with a race device, and a plurality of race participants each with a participant identification device, wherein the racer with the race device and the race participants are competing concurrently in the same race, on the same race course, crossing the same race gates;

the race device worn by the racer during the race, wherein the race device comprises a receiver, display, and processor, wherein the racer programs the race device with a selected race group, and wherein the race group comprises a plurality of race participants competing on the same race course;

the participant identification device, worn by registered race participants during the race, wherein the participant identification device transmits participant identification information to each race gate as each participant crosses the gate, wherein participant identification information comprises a time that each participant crosses each race gate linked with a unique participant identifier;

each race gate comprising a race gate mat, computer, software, and antennae, wherein participant identification information is linked with a time when each participant crosses each race gate;

locating the race gate in a race course configuration comprising a start gate, at least one mid-course gate, and a finish gate;

programming each race gate with a race course configuration wherein the race course configuration comprises the distance from each gate to the finish line, and the number of times each gate will be visited;

transmitting gate information over an effective range, by each race gate transmitter, to the race device worn by the racer, wherein the gate information transmitted comprises race course configuration, participant identification information, and linked participant time;

receiving the transmitted gate information, by the race device, while the racer with the race device is in the effective range of each race gate transmitter;

calculating, by the race device when the racer with the race device comes within the effective range, real-time race information comprising the race group leaders, the racer's position, pace, time back, and pace to win;

displaying real-time race information on the race device to the racer with the race device while the racer is still on the race course and in time to affect the outcome of the race;

updating the real-time race information displayed on the race device each time the racer with the race device crosses each race gate.

18. The system of claim 17 wherein the real-time race information comprises the current race group leader, the racer's position, pace, time back and pace to win.

19. The system of claim 17 wherein the real-time race information comprises the projected race group leader, the racer's position, pace, time back and pace to win.

20. The system of claim 17 wherein a kiosk may transmit race information comprising race course configuration, participant identification information, and race group information.

* * * * *